US011105019B2

(12) United States Patent
Sato et al.

(10) Patent No.: US 11,105,019 B2
(45) Date of Patent: Aug. 31, 2021

(54) POLYAMIDE FIBER CAPABLE OF HIGH-TEMPERATURE DYEING

(71) Applicant: Toray Industries, Inc., Tokyo (JP)

(72) Inventors: Kirita Sato, Aichi (JP); Yoshifumi Sato, Aichi (JP)

(73) Assignee: Toray Industries, Inc., Tokyo (JP)

( * ) Notice: Subject to any disclaimer, the term of this patent is extended or adjusted under 35 U.S.C. 154(b) by 242 days.

(21) Appl. No.: 15/774,696

(22) PCT Filed: Nov. 8, 2016

(86) PCT No.: PCT/JP2016/083132
§ 371 (c)(1),
(2) Date: May 9, 2018

(87) PCT Pub. No.: WO2017/082255
PCT Pub. Date: May 18, 2017

(65) Prior Publication Data

US 2018/0327933 A1 Nov. 15, 2018

(30) Foreign Application Priority Data

Nov. 10, 2015 (JP) ..... JP2015-220437

(51) Int. Cl.
*D01F 6/60* (2006.01)
*D04B 21/16* (2006.01)
(Continued)

(52) U.S. Cl.
CPC ..... *D01F 6/60* (2013.01); *D03D 15/00* (2013.01); *D04B 1/16* (2013.01); *D04B 21/16* (2013.01);
(Continued)

(58) Field of Classification Search
CPC ..... D01F 6/60; D10B 2331/02
See application file for complete search history.

(56) References Cited

U.S. PATENT DOCUMENTS 5,302,452 A * 4/1994 Kai ..... B29C 55/00 204/165
2005/0089654 A1* 4/2005 Yu ..... D03D 1/02 428/34.1
(Continued)

FOREIGN PATENT DOCUMENTS

CN 103290497 A 9/2013
EP 2 336 402 A1 6/2011
(Continued)

OTHER PUBLICATIONS

Extended European Search Report dated Jun. 17, 2019, of counterpart European Application No. 16864216.3.
(Continued)

*Primary Examiner* — Jennifer A Gillett
(74) *Attorney, Agent, or Firm* — DLA Piper LLP (US)

(57) ABSTRACT

A polyamide fiber which has a single fiber fineness of less than 5 dtex, and has a stress per unit fineness of 0.7 cN/dtex or more in 3% elongation in a tensile test of the fiber, in which a stress F1 in 3% elongation in a tensile test of the fiber before 100° C. boiling water treatment and a stress F2 in 3% elongation in a tensile test of the fiber after the treatment satisfy Formula (1):

$$F2/F1>0.7 \quad (1).$$

8 Claims, 1 Drawing Sheet

(51) Int. Cl.
*D03D 15/00* (2021.01)
*D04B 1/16* (2006.01)

(52) U.S. Cl.
CPC ..... *D10B 2331/02* (2013.01); *D10B 2401/04* (2013.01); *D10B 2401/14* (2013.01)

(56) References Cited

U.S. PATENT DOCUMENTS

2006/0234025 A1* 10/2006 Myard ..... C08J 5/24 428/292.1
2011/0020628 A1* 1/2011 Fukudome ..... C08G 69/28 428/221

FOREIGN PATENT DOCUMENTS

JP 2003-113531 A 4/2003
JP 2010-189806 A 9/2010
JP 2010-222721 A 10/2010
JP 2010-285709 A 12/2010
JP 3020-285709 A 12/2010
JP 2011-001635 A 1/2011
JP 2011-069013 A 4/2011
JP 2013-049930 A 3/2013
JP 5228983 B2 3/2013
WO 2013/129370 A1 9/2013

OTHER PUBLICATIONS

Office Action dated Apr. 9, 2020, of counterpart Taiwanese Application No. 105136345, along with an English Translation.
Guoming Wu et al., *Polymer Material Processing Technology*, China Textile Press, 1st Edition, Jul. 2000, p. 78.
First Office Action dated Dec. 2, 2019, of counterpart Chinese Application No. 201680064866.6, along with an English Translation.
Notification of Reasons for Refusal dated Jun. 2, 2020, of counterpart Japanese Application No. 2017-510436, along with an English Translation.
Office Action dated Jun. 26, 2020, of counterpart Indian Application No. 201847017255.
Guoming Wu et al., *Polymer Material Processing Technology*, China Textile Press, 1st Edition, Jul. 2000, p. 78, 80-82, 83 and 91.
The Second Office Action dated Aug. 7, 2020, of counterpart Chinese Application No. 201680064866.6, along with an English Translation.
Office Action dated Sep. 29, 2020, of counterpart Taiwsanese Application No. 105136345, along with an English Translation.

* cited by examiner

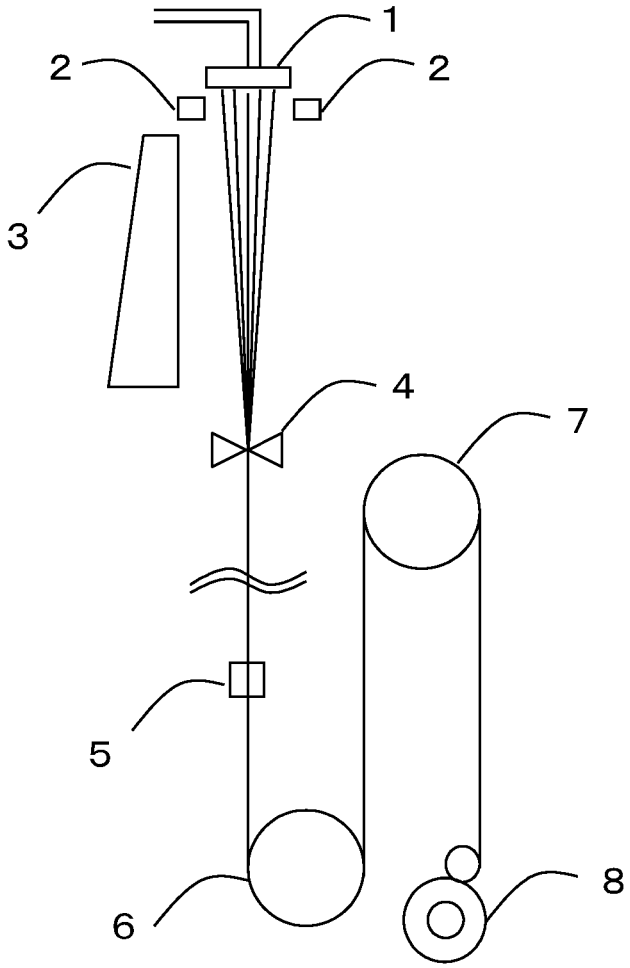
1
2
2
3
4
7
5
6
8

POLYAMIDE FIBER CAPABLE OF HIGH-TEMPERATURE DYEING

TECHNICAL FIELD

This disclosure relates to a polyamide fiber dyeable at a high temperature and excellent in quality of products thereof such as fabrics.

BACKGROUND

Polyamide fibers as typified by polycapramide and polyhexamethyleneadipamide are widely used for clothing material applications, industrial material applications and the like since they are excellent in mechanical properties, chemical resistance and heat resistance. In particular, owing to excellent strength, abrasion resistance and deep and rich dyeability, the fibers are used in various clothing material applications. With the recent progress of fashion diversification and application versatility, clothing fabrics having a chambray feeling of a good surface appearance are required for undergarments, sportswear, casual wear and the like.

As a production method of fabrics having a chambray feeling, for example, a method of producing woven fabrics and knitted fabrics by combining polyamide fibers and polyester fibers has been investigated. Polyamide fibers have a amide bond and an amino terminal group capable of forming an ionic bond with a dye molecule in the fiber structure thereof, and are well dyed with an ion-binding dye (acid dye or the like). However, polyester fibers do not have a structure of forming an ionic bond with a dye molecule in the fiber structure thereof and, therefore, could not be dyed with an ion-binding dye. In general, to dye polyester fibers, a disperse dye to dye them by adsorption in the adsorption site on the fiber structure is used. Accordingly, since polyamide fibers and polyester fibers are dyed with different dyes, the respective fibers can be dyed in different colors and, for example, in a fabric using polyamide fibers as the warps and using polyester fibers as the wefts, there develops a chambray effect to provide different colors depending on the viewing angle to the fabric.

On the other hand, a disperse dye dyes in the amorphous region of polyester fibers, and when polyester fibers are dyed with a disperse dye, it is necessary to dye them at a temperature not lower than the glass transition point of polyester fibers and, in general, the dyeing temperature of polyester fibers is a high temperature such as 120 to 130° C.

Consequently, in an interwoven or interknitted fabric of polyamide fibers and polyester fibers, there occurs a problem of wrinkling of the fabric since the heat resistance of polyamide fibers is poor.

Heretofore, various proposals have been made to improve heat resistance of polyamide fibers at a high temperature. For example, JP-A-2010-285709 proposes a multifilament having a low degree of hot water shrinkage, which uses polyamide 11 containing a hindered phenolic antioxidant and a phosphorus-containing processing heat stabilizer.

However, the filament of polyamide 11 disclosed in JP '709 is a yarn for false twisting that has an elongation degree of 53% or more and is therefore problematic in that the wrinkle resistance thereof is poor in use for raw yarns and that the product strength is low in use for fabrics. JP-A-2011-1635 proposes polyamide fibers having a high flexure recovery ratio that uses polyamide 610 or polyamide 612.

On the other hand, the polyamide fibers disclosed in JP '635 are spun under a high draw ratio condition and, therefore, have a large number of distortions in the fiber structure thereof and shrink much in dyeing at a high temperature, that is, the fibers have a problem of poor wrinkle resistance.

As described above, the polyamide fibers disclosed in JP '709 and JP '635 are poor in heat resistance in high-temperature dyeing at a temperature higher than 100° C. and, therefore, when interwoven or interknitted with polyester fibers and exposed to the condition of dyeing the polyester fibers, there occurs a serious problem of wrinkling of the fabric. Further, there also occurs a problem of lowering the product strength.

It could therefore be helpful to provide polyamide fibers excellent in heat resistance in high-temperature dyeing at a temperature higher than 100° C. and which, even when interwoven or interknitted with polyester fibers, are still excellent in wrinkle resistance of the fabric in dyeing, and are excellent in product strength.

SUMMARY

We thus provide:

(1) A polyamide fiber having a single fiber fineness of less than 5 dtex, and a stress per unit fineness of 0.7 cN/dtex or more in 3% elongation in a tensile test of the fiber, in which a stress F1 in 3% elongation in a tensile test of the fiber before 100° C. boiling water treatment and a stress F2 in 3% elongation in a tensile test of the fiber after the treatment satisfy Formula (1):

$$F2/F1>0.7 \quad (1).$$

(2) The polyamide fiber according to (1), in which the polyamide fiber has a stress per unit fineness of 2.0 cN/dtex or more in 15% elongation in a tensile test of the fiber, and a stress P1 in 15% elongation in a tensile test of the fiber before 100° C. boiling water treatment and a stress P2 in 15% elongation in a tensile test of the fiber after the treatment satisfy Formula (2):

$$P2/P1>0.8 \quad (2).$$

(3) The polyamide fiber according to (1) or (2), in which 50% by mass or more of monomers constituting polyamide contained in the polyamide fiber is a biomass-derived monomer.

(4) A fabric comprising the polyamide fiber according to any one of (1) to (3).

There can be provided polyamide fibers excellent in heat resistance in high-temperature dyeing at a temperature higher than 100° C. and which, even when interwoven or interknitted with polyester fibers, are still excellent in wrinkle resistance of the fabric in dyeing, and are excellent in product strength.

BRIEF DESCRIPTION OF THE DRAWINGS

FIG. 1 is an outline view showing one example of a production process for a polyamide fiber.

DESCRIPTION OF REFERENCE NUMERALS AND SIGNS

1: Spinning nozzle
2: Steam jetting device
3: Cooling device
4: Oiling device
5: Entangling nozzle device

6: Take-up roller
7: Stretching roller
8: Winder (winding device)

DETAILED DESCRIPTION

Our polyamide fibers will be described in detail hereinunder.

The polyamide used for the polyamide fiber is a so-called polymer form in which hydrocarbon groups are bonded to the main chain via amide bonds, and may be produced through polycondensation of an aminocarboxylic acid and a cyclic amide as starting materials or through polycondensation of a dicarboxylic acid and a diamine as starting materials. Hereinunder these starting materials are inclusively referred to as monomers.

The monomers are not specifically limited, but examples thereof include petroleum-derived monomers, biomass-derived monomers, and mixtures of petroleum-derived monomers and biomass-derived monomers. Recently, however, depletion of petroleum resources and global warming have become considered as problems, and in global approaches to solving environmental problems, it is desired to develop products using environmentally friendly materials that do not depend on petroleum resources. As such products, fibers, films and the like using renewable plant-derived resources as a part or all of the starting materials are specifically noted and, therefore, materials containing biomass-derived monomers are preferred. From the viewpoint of excellent environmental adaptability, it is more preferable that 50% by mass or more of the monomers constituting polyamide are biomass-derived monomers. The biomass-derived monomer units preferably account for 75% by mass or more, more preferably 100% by mass. The proportion of the biomass-derived monomers (bio-based synthetic polymer content) can be measured according to ISO 16620-3.

Regarding the polyamide for use in the polyamide fibers, the number of the methylene groups per one amide group is preferably 9 to 12 in the polyamide produced through polycondensation of an aminocarboxylic acid and a cyclic amide as starting materials, and is preferably 6 to 12 in the polyamide produced through polycondensation of a dicarboxylic acid and a diamine as starting materials. Examples of the polyamide having such a structure include polyundecane-lactam (bio-based synthetic polymer content: 99.9% by mass), polylauryl-lactam, polyhexamethylene-sebacamide, polypentamethylene-sebacamide and polyhexamethylene-dodecanediamide. Selecting the polyamide that falls within the range makes it possible to provide polyamide fibers in which the hydrogen bond between the amide bonds in the amorphous part is hardly cleaved even in high-temperature dyeing at a temperature higher than 100° C. to reduce fiber structure change and are excellent in wrinkle resistance of fabrics in dyeing. Above all, a more preferred polyamide polymer is polyhexamethylene-sebacamide (bio-based synthetic polymer content: 64.3% by mass) and polypentamethylene-sebacamide (bio-based synthetic polymer content: 99.9% by mass).

The viscosity of the polyamide may be so selected as to fall within a common-sense range for production of clothing fibers, and use of a polymer whose 98% sulfuric acid relative viscosity at 25° C. is 2.0 to 4.0 is preferred. When the viscosity thereof is 2.0 or more, the fibers formed of the polymer can have a sufficient strength, and when the viscosity thereof is 4.0 or less, the extrusion pressure of the molten polymer in spinning as well as the pressure increasing speed with time can be prevented from increasing and, therefore, it is possible to save any excessive load to the production equipment and the nozzle exchange cycle can be prolonged, that is, good productivity can be favorably realized. In addition, when a fabric is produced using the fibers falling within the above-mentioned range, the product strength of the resultant fabric, for example, the tear strength can be increased, that is, a fabric having a practical utilization-level can be obtained.

The polyamide may be copolymerized or mixed with any other second and third components in addition to the main component therein. As the copolymerization component, for example, the polyamide may contain a structural unit derived from an aliphatic dicarboxylic acid, an alicyclic dicarboxylic acid and an aromatic dicarboxylic acid, and the copolymerization amount is preferably 10 mol % or less as the carboxylic acid amount of the copolymerization component relative to the total carboxylic acid amount, more preferably 5 mol % or less.

The polyamide fiber may contain various inorganic additives and organic additives such as a delustering agent, a flame retardant, an antioxidant, a UV absorbent, an IR absorbent, a crystal nucleating agent, a fluorescent brightening agent, an antistatic agent, a moisture absorbent (polyvinyl pyrrolidone or the like), and a microbicide (silver zeolite, zinc oxide or the like). The content of these additives is preferably 0.001 to 10% by mass relative to polyamide.

The polyamide fiber is required to have a stress per unit fineness of 0.7 cN/dtex or more in 3% elongation in a tensile test of the fiber. The stress in 3% elongation in a tensile test of the fiber is determined as follows. A sample of the fiber is tested in a tensile test under a constant speed tensile condition indicated in JIS L1013 (Chemical Fiber Filament Test Method, 2010), and the stress thereof is derived from the strength at a point of 3% elongation of the sample on the tensile strength-elongation curve. The value calculated by dividing the strength by the fineness of the fiber is the stress per unit fineness in 3% elongation of the sample fiber.

The stress per unit fineness in 3% elongation is a parameter that indicates the rigidity of fiber, and a fiber having a larger value thereof is a more rigid fiber. Specifically, a fiber whose stress per unit fineness in 3% elongation is 0.7 cN/dtex can be prevented from deforming in high-temperature dyeing at a temperature higher than 100° C. and can have excellent wrinkle resistance. The stress per unit fineness in 3% elongation is preferably 0.8 cN/dtex or more.

In the polyamide fiber, it is required that a stress (F1) in 3% elongation in a tensile test of the fiber before 100° C. boiling water treatment and a stress (F2) in 3% elongation in a tensile test of the fiber after the boiling water treatment satisfy $F2/F1>0.7$. F2/F1 indicates the stress retention in 3% elongation in a tensile test of the fiber before and after boiling water treatment.

When a fiber is treated with boiling water, the fiber structure changes mainly in the amorphous part thereof, and the hydrogen bond between the amide bonds in the amorphous part is cleaved to enhance the mobility of the molecular chain, thereby lowering the alignment degree. As a result, owing to the fiber structure change and the alignment change in the amorphous part, the rigidity of the fiber decreases. Accordingly, to improve the wrinkle resistance of a fabric in high-temperature dyeing at a temperature higher than 100° C., it is important to maintain as much as possible the rigidity of fibers before and after boiling water treatment.

Specifically, when the stress retention in 3% elongation in a tensile test of a fiber before and after boiling water treatment is controlled so that $F2/F1>0.7$, the fiber structure change and the alignment change before and after high-temperature dyeing at a temperature higher than 100° C. can be reduced to maintain the fiber rigidity and the fiber deformation in dyeing can be thereby prevented, and accordingly, fibers excellent in wrinkle resistance can be realized. Preferably, F2/F1>0.8.

In the polyamide fiber, it is preferable that a stress per unit fineness in 15% elongation in a tensile test of the fiber is 2.0 cN/dtex or more. Like the stress in 3% elongation in a tensile test of the fiber, the stress in 15% elongation in a tensile test of the fiber can be determined as follows. A sample of the fiber is tested in a tensile test under a constant speed tensile condition indicated in JIS L1013 (Chemical Fiber Filament Test Method, 2010), and the stress thereof is derived from the strength at a point of 15% elongation of the sample on the tensile strength-elongation curve. The value calculated by dividing the strength by the fineness of the fiber is the stress per unit fineness in 15% elongation of the sample fiber. The parameter representing the strength of fiber is generally the strength of fiber at breakage in a tensile test of fiber, but the parameter representing the strength of a woven or knitted fabric is generally a burst strength or a tear strength thereof. However, there is not always any correlation between the strength of a fiber and the strength of a woven or knitted fabric. This is because, different from that in a tensile test for fibers, plural fibers are complicatedly arranged in a fabric product and the adjacent fibers would interfere with each other therein. We investigated the correlation between physical properties of fibers and those of fabric products and, as a result, found that the physical properties of fabric products may greatly differ depending on fabric designing and, for example, in the fabrics of the same design, there is a correlation between the stress per unit fineness in 15% elongation in a tensile test of fibers and the physical properties of the fabric products. Specifically, by controlling the stress per unit fineness in 15% elongation in a tensile test of fibers to fall within the above range, a fabric having excellent physical properties such as good tear strength can be obtained. More preferably, the stress per unit fineness in 15% elongation in a tensile test of fibers is 3.0 cN/dtex or more.

In the polyamide fiber, it is preferable that a stress P1 in 15% elongation in a tensile test of the fiber before 100° C. boiling water treatment and a stress P2 in 15% elongation in a tensile test of the fiber after the treatment satisfy P2/P1>0.8. P2/P1 indicates the stress retention in 15% elongation in a tensile test of the fiber before and after 100° C. boiling water treatment. As described above, the stress in 15% elongation in a tensile test of fibers has a correlation to the physical properties of fabrics, and when the stress retention in 15% elongation in a tensile test of fibers before and after 100° C. boiling water treatment is controlled so that P2/P1>0.8, the physical properties of fabrics in high-temperature dyeing at a temperature higher than 100° C. can be prevented from degrading and practicable products can be therefore provided. More preferably, P2/P1>0.85.

The single fiber fineness of the polyamide fiber must be less than 5 dtex. Controlling the fineness to fall within the range makes it possible to reduce the folding rigidity of the single fiber, and when wrinkles are generated, since the folding rigidity is small, the wrinkling resilience of the fibers becomes high. Therefore, fibers excellent in wrinkle resistance can be obtained. Preferably, the single fiber fineness of the polyamide fiber is less than 3 dtex.

The elongation of the polyamide fiber can be suitably defined depending on the use thereof, but from the viewpoint of processability thereof to give fabrics, the elongation is preferably 30 to 60%.

The moisture absorption ratio at 20° C. and 65% RH of the polyamide fiber is preferably less than 4.0%. Controlling the moisture absorption ratio of the polyamide fiber to fall within the range makes it possible to prevent the fiber from absorbing water in dyeing and, as a result, the fiber structure is not broken by water molecules even in a high-temperature state and the fibers are prevented from wrinkling even in dyeing at a temperature higher than 100° C. Preferably, the moisture absorption ratio is less than 3.5%.

Next, a preferred example to satisfy the stress in 3% elongation, the stress retention in 3% elongation in a tensile test of the fiber before and after 100° C. boiling water treatment, the stress in 15% elongation, and the stress retention in 15% elongation in a tensile test of the fiber before and after boiling water treatment is described.

One example of a production method for the polyamide fiber is described specifically with reference to FIG. 1. FIG. 1 is an outline view showing one example of a production process for the synthetic fiber.

A melt of polyamide chips is metered and transported via a gear pump, ejected out through a spinning nozzle 1, led to pass through a steam jetting device 2 arranged just below the spinning nozzle 1, from which steam is jetted toward the face of the spinning nozzle 1, and through a region arranged on the downstream side of the steam jetting device 2, in which cooling air is blown from a cooling device 3, to thereby cool the fibers to room temperature to solidify them, and then oiling the fibers in an oiling device 4 to bundle them, entangling the resultant bundles in an entangling nozzle device 5, then making them to pass through a take-up roller 6 and a stretching roller 7. In this time, the fibers are stretched according to the peripheral speed ratio of the take-up roller 6 and the stretching roller 7. Further, the fibers are heat-set by heating the stretching roller 7, and then wound up with a winder (winding device) 8.

Our polyamide fiber is obtained by the above-mentioned production method.

To obtain the polyamide fiber, it is important that polyamide having a suitable molecular structure is selected, and the spinning draft and the moisture absorption ratio of the fiber are favorably controlled. These are described in detail hereunder.

Regarding the polyamide for use in the polyamide fibers, as described above, the number of the methylene groups per one amide group is preferably 9 to 12 in the polyamide produced through polycondensation of an aminocarboxylic acid and a cyclic amide as starting materials, and is preferably 6 to 12 in the polyamide produced through polycondensation of a dicarboxylic acid and a diamine as starting materials.

The wrinkle resistance of the polyamide fiber in high-temperature dyeing at a temperature higher than 100° C. has a correlation with the stress in 3% elongation in a tensile test of the polyamide fiber. The stress in 3% elongation indicates rigidity, and the rigidity of the fiber is determined by the crystal and amorphous structure of the fiber. Polyamide forms a crystal by forming a hydrogen bond intramolecularly and intermolecularly between the amide bonds therein, but even in the amorphous part therein, polyamide may form a hydrogen bond intramolecularly and intermolecularly between the amide bonds therein. As described above, when polyamide fibers are treated with boiling water or subjected to high-temperature dyeing at a temperature higher than 100° C., the hydrogen bonds in the amorphous part therein are mainly cleaved to cause fiber structure change and alignment degree change in the amorphous part. As a result, the rigidity of the fibers lowers and the fibers are wrinkled in high-temperature dyeing at a temperature higher than 100° C. Though forming hydrogen bonds therein, the structure of the amorphous part differs from that of the crystalline part and forms a distorted structure. The difficulty in cleaving the hydrogen bonds in the amorphous part depends on the degree of structure distortion in the amorphous part. Specifically, when the structure in the amorphous part is less distorted, the hydrogen bonds in the amorphous part are less cleaved. The structure distortion in the amorphous part depends on the hydrogen bond forming performance between the amide bonds in polyamide, that is, on the degree of freedom of the molecular main chain of polyamide. The degree of freedom of the molecular main chain of polyamide as referred to herein is determined by the distance between the amide bonds in one molecule of polyamide, that is, determined by the number of the methylene groups in one amide bond therein. When the number of the methylene groups in one amide bond is larger, the distance between the amide bonds in one molecule of polyamide is longer, and the degree of freedom of the polyamide molecule main chain in forming hydrogen bonds in the amorphous part becomes larger. Therefore, the formation of hydrogen bond between the amide bonds in the amorphous part of polyamide is facilitated, and the distortion of the structure in the amorphous part is reduced.

Consequently, selecting the polyamide that falls within the above-described range realizes a polyamide fiber in which the hydrogen bond between the amide bonds in the amorphous part is hardly cleaved even in high-temperature dyeing at a temperature higher than 100° C., in which the fiber structure change is reduced, and which is excellent in wrinkle resistance of fabrics in dyeing.

In production of the polyamide fiber, the ratio of take-up speed of the take-up roller to nozzle discharge linear velocity is preferably 70 or more and less than 200. The nozzle discharge linear velocity is a value calculated by dividing the discharge volume per unit time of the polymer discharged out from the discharge hole of a spinning nozzle by the cross-sectional area of the nozzle hole, and the ratio of take-up speed of the take-up roller to nozzle discharge linear velocity is a parameter to determine the alignment degree of the polymer discharged out from the discharge hole of the spinning nozzle. By controlling the ratio to fall within the range, the alignment of fibers is promoted within a period of time from cooling the discharged polymer to taking up it around a take-up roller, whereby the rigidity of the fibers is increased, and accordingly, the fibers are hardly deformed even in high-temperature dyeing at a temperature higher than 100° C., that is, fibers excellent in wrinkle resistance can be obtained. More preferably, the ratio is 100 or more and less than 180.

Fibers absorb water from the dyeing liquid during dyeing, and come to contain water molecules in the fiber structure thereof. When heated at a high temperature in the state where the fiber structure contains water molecules, the water molecules act as a plasticizer to cleave the hydrogen bonds in the fibers. Consequently, as mentioned above, the moisture absorption ratio at 20° C. and 65% RH of the polyamide fiber is preferably less than 4.0%, more preferably less than 3.5%.

As a method of controlling the moisture absorption ratio at 20° C. and 65% RH of the polyamide fiber, it is preferable that, in the production of the polyamide fiber, the water content of the fiber chips is controlled to 0.01 to 0.15% by mass. Controlling the water content of the chips to fall within the above-described range makes it possible to prevent thermal decomposition of the polyamide in a spinning step, prevent increase in the amount of the functional group at the polymer terminal to which water molecules may bond, and retard introduction of water molecules into the fiber structure. More preferably, the water content of the fiber chips is 0.03 to 0.12% by mass.

The polyamide fiber may be a monofilament of one single fiber, or may be a multifilament formed of plural single fibers.

The cross-sectional profile of the polyamide fiber is not limited to a circular cross section, but may include other various cross-sectional profiles of a flattened one, a Y-shaped one, a T-shaped one, a hollow one, one having a shape formed of two pairs of sheets, a hash mark-type one and the like.

EXAMPLES

Our polyamide fibers are described with reference to Examples. The measurement methods in Examples are as follows.

Measurement Methods

A. Sulfuric Acid Relative Viscosity 0.25 g of a sample was dissolved in sulfuric acid having a concentration of 98 wt % such that the sample could be 1 g in 100 ml of the sulfuric acid. Using an Ostwald viscometer, the time of flow (T1) of the sample at 25° C. was measured. Subsequently, the time of flow (T2) of sulfuric acid having a concentration of 98 wt % alone was measured. The ratio of T1 to T2, that is, T1/T2 was referred to as the sulfuric acid relative viscosity of the sample.

B. Melting Point (Tm)

Using a differential scanning colorimeter manufactured by Perkin Elmer, DSC-7 Model, 20 mg of a sample polymer was heated from 20° C. up to 270° C. at a heating rate of 20° C./min, then kept at the temperature of 270° C. for 5 minutes, and thereafter cooled from 270° C. down to 20° C. at a cooling rate of 20° C./min, and kept at the temperature of 20° C. for 1 minute. This is the first run. Next, as the second run, the sample was heated from 20° C. up to 270° C. at a heating rate of 20° C./min, and the temperature of the exothermic peak observed in this run was referred to as the melting point of the sample.

C. Fineness

Using a sizing reel having a framework circumference of 1.125 m, a sample was reeled up into a 200-reel skein, and dried with a hot air drier (105±2° C.×60 min), the skein weight was measured with a weighing scale, and the fineness was calculated by multiplying the skein weight by the official regain. The measurement was repeated four times, and the average value thereof was referred to as the fineness. The resultant fineness was divided by the number of the filaments to obtain a single fiber fineness.

D. Strength and Elongation

Using Orientec's "TENSILON" (registered trade mark) UCT-100 as a measuring machine, a sample was tested under the constant rate elongation condition indicated in JIS L1013 (Chemical Fiber Filament Test Method, 2010). The elongation was obtained from the value at the point showing the highest strength on the tensile strength-elongation curve. A value calculated by dividing the maximum strength by the fineness was referred to as the strength of the sample. The same measurement was repeated 10 times, and the average value thereof was referred to as the strength and the elongation.

E. Stress in 3% or 15% Elongation

According to the tensile test method of the above-described item D, a sample was tested, and the strength at the point at which the sample showed 3% or 15% elongation on the tensile strength-elongation curve was referred to as the stress in 3% elongation and the stress in 15% elongation, respectively. The same measurement was repeated 10 times, and the average value thereof was referred to as the stress in 3% elongation and the stress in 15% elongation, respectively.

F. Boiling Water Shrinkage

Using a reeling machine having a framework circumference of 1.125 m, the resultant polyamide fiber was reeled up into a 20-reel skein, and the initial length $L_0$ thereof was measured under a load of 0.09 cN/dtex. Next, in a boiling water under no load, the fiber was treated for 30 minutes, and then dried with air. Next, the fiber was treated under a load of 0.09 cN/dtex, and the length thereof $L_1$ was measured. The boiling water shrinkage of the fiber was calculated according to the formula:

$$\text{Boiling water shrinkage}(\%)=[(L_0-L_1)/L_0]\times 100.$$

G. Chip Water Content

Using a water vaporization apparatus, Mitsubishi Chemical Analytic's VA-200 Model, 1 g of sample chips were heated in a nitrogen stream atmosphere at 230° C. for 30 minutes, and water generated from the chips was quantified through coulometric titration, using a micro water content measuring apparatus, Mitsubishi Chemical Analytic's CA-200 Model.

H. Moisture Absorption Ratio of Fiber

Using a reeling machine having a framework circumference of 1.125 m, the resultant polyamide fiber was reeled up into a 20-reel skein to be a sample. The sample was put into a weighing bottle, dried at 110° C. for 2 hours, and the mass thereof was measured to be $w_0$. Next, the dried sample was kept at a temperature of 20° C. and a relative humidity of 65% for 24 hours, and then the mass thereof was measured to be $w_{65}$%. At this time, the value calculated according to the formula was referred to as the moisture absorption ratio MR of the fiber at 20° C.×65% RH:

$$MR=[(w_{65\%}-w_0)/w_0]\times 100.$$

I. Wrinkle Resistance Evaluation

A woven fabric using the polyamide fiber as the warp and the weft was dyed at 120° C., rinsed with flowing water, dewatered and dried, and the appearance of the resultant fabric was observed to evaluate the wrinkle resistance thereof. The appearance observation method and the evaluation method for the fabric were carried out according to the methods described in Item 9 of JIS L1059-2 (Wrinkle resistance test method for fiber products—Part 2: Appearance evaluation after wrinkling (wrinkle method), 2009), and the fabric was ranked from Level 5 (most smooth appearance) to Level 1 (most wrinkled appearance).

J. Tear Strength of Fabric

The tear strength of fabric was measured according to the tear strength JIS Method, D method (wet grab method) defined in 8.14.1 of JIS L 1096 (Testing methods for woven and knitted fabrics). A sample of fabric was analyzed in both the warp direction and the weft direction, and when the tear strength in both the warp direction and the weft direction is 6.0 N or more, it was considered that the sample had a strength enough for practical use.

Example 1

Production of Polyamide Fiber

As a polyamide, polyhexamethylene-sebacamide (sulfuric acid relative viscosity: 2.67, melting point: 225° C., bio-based synthetic polymer content: 64.3% by mass) was selected, and the water content of the polyhexamethylene-sebacamide chips was controlled to be 0.03% by weight. This was put into the spinning machine shown in FIG. 1, melted at a spinning temperature of 285° C., and spun out through the spinning nozzle 1 with 80 round holes each having a discharge hole diameter of 0.16 mm and a hole length of 0.32 mm. Cold air was sprayed onto the fiber in the cooling device 3 to cool and solidify the fiber, and the fiber was oiled in the oiling device 4, entangled in the entangling nozzle device 5 and taken up with the take-up roller 6 having a peripheral speed (take-up speed) of 2105 m/min (setup value). Subsequently, the fiber taken up with the take-up roller 6 was taken up with the stretching roller 7 having a surface temperature of 155° C. to be stretched to a stretching draw ratio of 2.00 times between the rollers, and then wound up with the winder 8 set to have a winding speed of 4000 m/min (setup value) to obtain a polyhexamethylene-sebacamide multifilament of 22 dtex-20 filaments. Regarding the resultant polyhexamethylene-sebacamide multifilament, the fineness, the strength, the elongation, the stress in 3% elongation, the stress in 15% elongation, the boiling water shrinkage, the moisture absorption ratio at 20° C.×65% RH, and the stress retention in 3% elongation and the stress retention in 15% elongation before and after boiling water treatment were evaluated. The results are shown in Table 1.

Production of Fabric

Using the resultant polyamide multifilament as the warp and the weft, a plain weave fabric having preset parameters of a warp density of 188 fibers/2.54 cm and a weft density of 155 fibers/2.54 mm was woven.

According to an ordinary method, the resultant unprocessed fabric was refined with a solution containing 2 g/liter of sodium hydroxide (NaOH) in an open soaper, dried at 120° C. in a cylinder drier, and then preset at 170° C. Subsequently, in a pressure-resistant drum-type dyeing machine, this was heated up to 120° C. at a rate of 2.0° C./min, and then dyed at the set temperature of 120° C. for 60 minutes. After the dyeing, this was rinsed with flowing water for 20 minutes, dewatered and dried to obtain a fabric having a warp density of 200 fibers/2.54 cm and a weft density of 160 fibers/2.54 cm. The resultant woven fabric was evaluated for the wrinkle resistance and the tear strength according to the above-mentioned methods. The results are shown in Table 1.

Example 2

A polyhexamethylene-sebacamide multifilament and a woven fabric were produced under the same condition as in Example 1, except that polyhexamethylene-sebacamide (sulfuric acid relative viscosity: 2.67, melting point: 225° C.) which was the same as in Example 1 was selected as a polyamide and the water content of the polyhexamethylene-sebacamide was controlled to be 0.12% by weight. The evaluation results of the resultant multifilament and fabric are shown in Table 1.

Example 3

As a polyamide, polyhexamethylene-sebacamide (sulfuric acid relative viscosity: 2.67, melting point: 225° C.) which was the same as in Example 1 was selected, and the water content of the polyhexamethylene-sebacamide chips was controlled to be 0.03% by weight. This was put into the spinning machine shown in FIG. 1, melted at a spinning temperature of 285° C., and spun out through the spinning nozzle 1 with 80 round holes each having a discharge hole diameter of 0.20 mm and a hole length of 0.50 mm. Cold air was sprayed onto the fiber in the cooling device 3 to cool and solidify the fiber, and the fiber was oiled in the oiling device 4, entangled in the entangling nozzle device 5 and taken up with the take-up roller 6 having a peripheral speed (take-up speed) of 2442 m/min(setup value). Subsequently, the fiber taken up with the take-up roller 6 was taken up with the stretching roller 7 having a surface temperature of 155° C. to be stretched to a stretching draw ratio of 2.00 times between the rollers, and then wound up with the winder 8 set to have a winding speed of 4500 m/min (setup value) to obtain a polyhexamethylene-sebacamide multifilament of 22 dtex-20 filaments. Using the resultant multifilament and under the same condition as in Example 1, a woven fabric was produced. The evaluation results of the resultant multifilament and woven fabric are shown in Table 1.

Example 4

As a polyamide, polyhexamethylene-sebacamide (sulfuric acid relative viscosity: 2.67, melting point: 225° C.) which was the same as in Example 1 was selected, spun out through the spinning nozzle 1 under the same condition as in Example 1, and then taken up with the take-up roller 6 having a peripheral speed (take-up speed) of 1275 m/min (setup value). Subsequently, the fiber taken up with the take-up roller 6 was taken up with the stretching roller 7 having a surface temperature of 155° C. to be stretched to a stretching draw ratio of 2.45 times between the rollers, and then wound up with the winder 8 set to have a winding speed of 3000 m/min (setup value) to give a polyhexamethylene-sebacamide multifilament of 22 dtex-20 filaments. Using the resultant multifilament and under the same condition as in Example 1, a woven fabric was produced. The evaluation results of the resultant multifilament and woven fabric are shown in Table 1.

Example 5

As a polyamide, polyhexamethylene-sebacamide (sulfuric acid relative viscosity: 2.10, melting point: 225° C., bio-based synthetic polymer content: 64.3% by mass) was selected, and the water content of the polyhexamethylene-sebacamide chips was controlled to be 0.15% by weight. This was put into the spinning machine shown in FIG. 1, melted at a spinning temperature of 270° C., and spun out through the spinning nozzle 1 with 80 round holes each having a discharge hole diameter of 0.16 mm and a hole length of 0.32 mm. Cold air was sprayed onto the fiber in the cooling device 3 to cool and solidify the fiber, and the fiber was oiled in the oiling device 4, entangled in the entangling nozzle device 5 and taken up with the take-up roller 6 having a peripheral speed (take-up speed) of 2105 m/min(setup value). Subsequently, the fiber taken up with the take-up roller 6 was taken up with the stretching roller 7 having a surface temperature of 155° C. to be stretched to a stretching draw ratio of 2.00 times between the rollers, and then wound up with the winder 8 set to have a winding speed of 4000 m/min (setup value) to obtain a polyhexamethylene-sebacamide multifilament of 22 dtex-20 filaments. The evaluation results of the resultant multifilament and woven fabric are shown in Table 1.

Example 6

A multifilament and a woven fabric were produced under the same condition as in Example 1, except that polyhexamethylene-sebacamide (sulfuric acid relative viscosity: 2.67, melting point: 225° C.) which was the same as in Example 1 was selected as a polyamide, the water content of the polyhexamethylene-sebacamide chips was controlled to be 0.03% by weight, the polyamide was put into the spinning machine shown in FIG. 1, melted at a spinning temperature of 285° C. and spun out through the spinning nozzle 1 having 32 round holes each having a discharge hole diameter of 0.25 mm and a hole length of 0.625 mm. The evaluation results of the resultant multifilament and fabric are shown in Table 1.

Example 7

A multifilament and a woven fabric were produced under the same condition as in Example 1, except that polyhexamethylene-sebacamide (sulfuric acid relative viscosity: 2.67, melting point: 225° C.) which was the same as in Example 1 was selected as a polyamide, the water content of the polyhexamethylene-sebacamide chips was controlled to be 0.03% by weight, the polyamide was put into the spinning machine shown in FIG. 1, melted at a spinning temperature of 285° C. and spun out through the spinning nozzle 1 having 20 round holes each having a discharge hole diameter of 0.3 mm and a hole length of 0.75 mm. The evaluation results of the resultant multifilament and fabric are shown in Table 1.

Example 8

A multifilament and a woven fabric were produced under the same condition as in Example 1, except that polyundecane-lactam (sulfuric acid relative viscosity: 2.01, melting point: 185° C., bio-based synthetic polymer content: 99.9% by mass) was selected as a polyamide. The evaluation results of the resultant multifilament and fabric are shown in Table 1.

Example 9

A polypentamethylene-sebacamide multifilament and a woven fabric were produced under the same condition as in Example 1, except that polypentamethylene-sebacamide (sulfuric acid relative viscosity: 2.65, melting point: 215° C., bio-based synthetic polymer content: 99.9% by mass) was selected as a polyamide and the water content of the polypentamethylene-sebacamide was controlled to be 0.12% by weight. The evaluation results of the resultant multifilament and fabric are shown in Table 1.

TABLE 1

| | | Example 1 | Example 2 | Example 3 | Example 4 | Example 5 | Example 6 | Example 7 | Example 8 | Example 9 |
|---|---|---|---|---|---|---|---|---|---|---|
| Starting material polymer | Species of polyamide | N610 | N610 | N610 | N610 | N610 | N610 | N610 | N11 | N510 |
| | Sulfuric acid relative viscosity | 2.67 | 2.67 | 2.67 | 2.67 | 2.10 | 2.67 | 2.67 | 2.01 | 2.65 |
| | Melting point (° C.) | 225 | 225 | 225 | 225 | 225 | 225 | 225 | 185 | 215 |

TABLE 1-continued

| | | Example 1 | Example 2 | Example 3 | Example 4 | Example 5 | Example 6 | Example 7 | Example 8 | Example 9 |
|---|---|---|---|---|---|---|---|---|---|---|
| | Chip water content (wt %) | 0.03 | 0.12 | 0.03 | 0.03 | 0.15 | 0.03 | 0.03 | 0.03 | 0.12 |
| | Polyamide structure*1) | A | A | A | A | A | A | A | B | A |
| | Number of methylene groups/number of amide groups | 7 | 7 | 7 | 7 | 7 | 7 | 7 | 10 | 7 |
| Spinning condition | Nozzle discharge linear velocity/take-up roller speed | 103 | 103 | 166 | 83 | 103 | 100 | 90 | 99 | 103 |
| Fiber properties | Multifilament total fineness (dtex) | 22 | 22 | 22 | 22 | 22 | 22 | 22 | 22 | 22 |
| | Single fiber fineness (dtex) | 1.1 | 1.1 | 1.1 | 1.1 | 1.1 | 2.8 | 4.4 | 1.1 | 1.1 |
| | Strength (cN/dtex) | 6.4 | 6.3 | 6.5 | 6.3 | 4.5 | 5.8 | 5.5 | 5.0 | 5.9 |
| | Elongation (%) | 43 | 43 | 42 | 47 | 55 | 46 | 46 | 44 | 42 |
| | Fiber moisture absorption ratio (%) | 3.4 | 3.8 | 3.4 | 3.4 | 3.9 | 3.4 | 3.4 | 3.2 | 3.6 |
| | Boiling water shrinkage (%) | 8 | 8 | 10 | 7 | 7 | 8 | 8 | 8 | 7 |
| | Stress in 3% elongation before boiling water treatment [F1] (cN/dtex) | 0.86 | 0.83 | 0.77 | 0.73 | 0.71 | 0.95 | 1.02 | 0.70 | 0.79 |
| | Stress in 3% elongation after boiling water treatment [F2] (cN/dtex) | 0.68 | 0.59 | 0.62 | 0.59 | 0.57 | 0.81 | 0.86 | 0.51 | 0.58 |
| | Stress retention in 3% elongation [F2/F1] (%) | 0.88 | 0.81 | 0.72 | 0.71 | 0.80 | 0.85 | 0.84 | 0.73 | 0.73 |
| | Stress in 15% elongation before boiling water treatment [P1] (cN/dtex) | 3.9 | 3.8 | 3.9 | 4.2 | 2.5 | 3.1 | 2.9 | 2.3 | 3.6 |
| | Stress in 15% elongation after boiling water treatment [P2] (cN/dtex) | 3.6 | 3.1 | 3.4 | 3.4 | 2.1 | 2.8 | 2.6 | 2.0 | 3.0 |
| | Stress retention in 15% elongation [P2/P1] (%) | 0.92 | 0.82 | 0.87 | 0.82 | 0.84 | 0.90 | 0.90 | 0.87 | 0.83 |
| Fabric evaluation | Wrinkle resistance | 5 | 5 | 4 | 4 | 4 | 5 | 4 | 4 | 5 |
| | Fabric tear strength [warp direction/weft direction] (N) | 13.1/10.5 | 12.7/10.1 | 12.9/10.1 | 12.9/10.2 | 8.5/8.1 | 11.7/9.7 | 10.9/9.0 | 8.5/6.4 | 12.4/9.8 |

*1)Polyamide structure A: polyamide obtained through polycondensation of diamine and dicarboxylic acid. Polyamide structure B: polyamide obtained through polycondensation of aminocarboxylic acid and cyclic amide.

Comparative Example 1

Polyhexamethylene-sebacamide (sulfuric acid relative viscosity: 2.67, melting point: 225° C.) which was the same as in Example 1 was selected as a polyamide, spun out through the spinning nozzle 1 under the same condition as in Example 1, and then taken up with the take-up roller 6 at a peripheral speed (take-up speed) thereof of 4000 m/min (setup value). Subsequently, the fiber taken up with the take-up roller 6 was taken up with the stretching roller 7 having a surface temperature of 25° C., and wound up with the winder 8 at a winding speed of 4000 m/min (setup value) without being stretched between the rollers to obtain a polyhexamethylene-sebacamide multifilament of 22 dtex-20 filaments. Using the resultant multifilament and under the same condition as in Example 1, a fabric was produced. The evaluation results of the resultant multifilament and fabric are shown in Table 2.

Comparative Example 2

Polyhexamethylene-sebacamide (sulfuric acid relative viscosity: 2.67, melting point: 225° C.) which was the same as in Example 1 was selected as a polyamide, spun out through the spinning nozzle 1 under the same condition as in Example 1, and then taken up with the take-up roller 6 at a peripheral speed (take-up speed) thereof of 1132 m/min (setup value). Subsequently, the fiber taken up with the take-up roller 6 was taken up with the stretching roller 7 having a surface temperature of 155° C., while stretched to a stretching draw ratio of 3.80 times between the rollers, and wound up with the winder 8 at a winding speed of 4000 m/min (setup value) to obtain a polyhexamethylene-sebacamide multifilament of 22 dtex-20 filaments. Using the resultant multifilament and under the same condition as in Example 1, a fabric was produced. The evaluation results of the resultant multifilament and fabric are shown in Table 2.

Comparative Example 3

A polyhexamethylene-sebacamide multifilament and a woven fabric were produced under the same condition as in Example 1, except that polyhexamethylene-sebacamide (sulfuric acid relative viscosity: 2.67, melting point: 225° C.) which was the same as in Example 1 was selected as a polyamide and the water content of the polyhexamethylene-sebacamide chips was controlled to be 0.20% by weight. The evaluation results of the resultant multifilament and fabric are shown in Table 2.

Comparative Example 4

Polyhexamethylene-sebacamide (sulfuric acid relative viscosity: 2.10, melting point: 225° C.) which was the same as in Example 5 was selected as a polyamide, the water content of the polyhexamethylene-sebacamide chips was controlled to be 0.15% by weight, and this was put into the spinning machine shown in FIG. 1, melted at a spinning temperature of 270° C., and spun out through the spinning nozzle 1 having 80 round holes each having a discharge hole diameter of 0.25 mm and a hole length of 0.625 mm. Cold air was sprayed onto the fiber in the cooling device 3 to cool and solidify the fiber, and the fiber was oiled in the oiling device 4, entangled in the entangling nozzle device 5 and taken up with the take-up roller 6 having a peripheral speed (take-up speed) of 2105 m/min(setup value). Subsequently, the fiber taken up with the take-up roller 6 was taken up with the stretching roller 7 having a surface temperature of 155° C. to be stretched to a stretching draw ratio of 2.00 times between the rollers, and then wound up with the winder 8 set to have a winding speed of 4000 m/min (setup value) to obtain a polyhexamethylene-sebacamide multifilament of 22 dtex-20 filaments. The evaluation results of the resultant multifilament and fabric are shown in Table 2.

Comparative Example 5

A multifilament and a woven fabric were produced under the same condition as in Example 1, except that polyhexamethylene-sebacamide (sulfuric acid relative viscosity: 2.67, melting point: 225° C.) which was the same as in Example 1 was selected as a polyamide, the water content of the polyhexamethylene-sebacamide chips was controlled to be 0.03% by weight, the polyamide was put into the spinning machine shown in FIG. 1, melted at a spinning temperature of 285° C., and spun out through the spinning nozzle 1 having 12 round holes each having a discharge hole diameter of 0.35 mm and a hole length of 0.875 mm. The evaluation results of the resultant multifilament and fabric are shown in Table 2.

Comparative Example 6

A multifilament and a woven fabric were produced under the same condition as in Example 1, except that polyhexamethylene-adipamide (sulfuric acid relative viscosity: 2.80, melting point: 262° C.) was selected as a polyamide. The evaluation results of the resultant multifilament and fabric are shown in Table 2.

Comparative Example 7

A multifilament and a woven fabric were produced under the same condition as in Example 1, except that polycaprolactam (sulfuric acid relative viscosity: 2.70, melting point: 225° C.) was selected as a polyamide. The evaluation results of the resultant multifilament and fabric are shown in Table 2.

Comparative Example 8

A multifilament and a woven fabric were produced under the same condition as in Example 1, except that polyundecane-lactam (sulfuric acid relative viscosity: 2.01, melting point: 185° C.) which was the same as in Example 8 was selected as a polyamide, the water content of polyundecane-lactam chips was controlled to be 0.05% by weight, the polyamide was melted at a spinning temperature of 250° C., spun out through the spinning nozzle 1 with 80 round holes each having a discharge hole diameter of 0.21 mm and a hole length of 0.52 mm, and taken up with the take-up roller 6 having a peripheral speed (take-up speed) of 3000 m/min (setup value), then the fiber taken up with the take-up roller 6 was taken up with the stretching roller 7 having a surface temperature of 130° C. to be stretched to a stretching draw ratio of 1.50 times between the rollers, followed by winding up with the winder 8 set to have a winding speed of 4400 m/min (setup value). The evaluation results of the resultant multifilament and woven fabric are shown in Table 2.

TABLE 2

| | | Comp. Ex. 1 | Comp. Ex.2 | Comp. Ex.3 | Comp. Ex. 4 | Comp. Ex. 5 | Comp. Ex. 6 | Comp. Ex. 7 | Comp. Ex. 8 |
|---|---|---|---|---|---|---|---|---|---|
| Starting material polymer | Species of polyamide | N610 | N610 | N610 | N610 | N610 | N66 | N6 | N11 |
| | Sulfuric acid relative viscosity | 2.67 | 2.67 | 2.67 | 2.10 | 2.67 | 2.80 | 2.70 | 2.01 |
| | Melting point (° C.) | 225 | 225 | 225 | 225 | 225 | 262 | 225 | 185 |
| | Chip water content (wt %) | 0.03 | 0.03 | 0.20 | 0.15 | 0.03 | 0.03 | 0.03 | 0.05 |
| | Polyamide structure*1) | A | A | A | A | A | A | B | B |
| | Number of methylene groups/number of amide groups | 7 | 7 | 7 | 7 | 7 | 5 | 5 | 10 |
| Spinning condition | Nozzle discharge linear velocity/take-up roller speed | 195 | 55 | 103 | 251 | 74 | 110 | 110 | 221 |
| Fiber properties | Multifilament total fineness (dtex) | 22 | 22 | 22 | 22 | 22 | 22 | 22 | 22 |
| | Single fiber fineness (dtex) | 1.1 | 1.1 | 1.1 | 1.1 | 7.3 | 1.1 | 1.1 | 1.1 |
| | Strength (cN/dtex) | 4.5 | 7.2 | 6.1 | 4.5 | 5.3 | 6.2 | 6.2 | 4.6 |
| | Elongation (%) | 80 | 30 | 45 | 55 | 46 | 45 | 48 | 58 |
| | Fiber moisture absorption ratio (%) | 3.4 | 3.4 | 4.5 | 3.9 | 3.4 | 4.9 | 5.5 | 3.3 |
| | Boiling water shrinkage (%) | 5 | 11 | 9 | 7 | 8 | 10 | 14 | 7 |
| | Stress in 3% elongation before boiling water treatment [F1] (cN/dtex) | 0.60 | 1.48 | 0.68 | 0.71 | 1.05 | 0.71 | 0.70 | 0.65 |
| | Stress in 3% elongation after boiling water treatment [F2] (cN/dtex) | 0.48 | 0.89 | 0.55 | 0.50 | 0.86 | 0.46 | 0.35 | 0.44 |
| | Stress retention in 3% elongation [F2/F1] (%) | 0.80 | 0.60 | 0.81 | 0.70 | 0.82 | 0.65 | 0.50 | 0.68 |
| | Stress in 15% elongation before boiling water treatment [P1] (cN/dtex) | 1.3 | 5.0 | 3.6 | 2.5 | 2.6 | 3.9 | 4.0 | 2.2 |
| | Stress in 15% elongation after boiling water treatment [P2] (cN/dtex) | 1.1 | 3.5 | 2.7 | 1.9 | 2.3 | 1.8 | 1.5 | 1.7 |
| | Stress retention in 15% elongation [P2/P1] (%) | 0.85 | 0.70 | 0.75 | 0.76 | 0.88 | 0.46 | 0.38 | 0.77 |
| Fabric evaluation | Wrinkle resistance | 3 | 1 | 2 | 2 | 2 | 2 | 1 | 2 |
| | Fabric tear strength [warn direction/weft direction] (N) | 5.5/4.7 | 6.8/5.1 | 7.6/6.7 | 5.8/5.5 | 9.8/8.2 | 6.5/4.4 | 6.0/4.0 | 5.6/5.2 |

*1)Polyamide structure A: polyamide obtained through polycondensation of diamine and dicarboxylic acid. Polyamide structure B: polyamide obtained through polycondensation of aminocarboxylic acid and cyclic amide.

INDUSTRIAL APPLICABILITY

We provide a polyamide fiber excellent in heat resistance in high-temperature dyeing at a temperature higher than 100° C. and, when interwoven or interknitted with polyester fibers, still excellent in wrinkle resistance of the fabric in dyeing, and excellent in product strength.

This application is based on Japanese Patent Application No. 2015-220437 filed on Nov. 10, 2015, the contents of which are incorporated herein by reference.

The invention claimed is:

1. A polyamide fiber having a single fiber fineness of less than 5 dtex, an elongation of 30 to 60%, and a stress per unit fineness of 0.7 cN/dtex or more in 3% elongation in a tensile test of the fiber, wherein a stress F1 in 3% elongation in a tensile test of the fiber before 100° C. boiling water treatment under no load for 30 minutes and a stress F2 in 3% elongation in a tensile test of the fiber after the treatment satisfy Formula (1):

$$F2/F1>0.7 \quad (1),$$

wherein the fiber is formed from a polyamide selected from the group consisting of polyundecane-lactam, polylauryl-lactam, polyhexamethylene-sebacamide, polypentamethylene-sebacamide, and polyhexamethylene-dodecanediamide and the fiber is produced by a process having a ratio of a take-up speed of a take-up roller to a nozzle discharge linear velocity of 70 or more and less than 200.

2. The polyamide fiber according to claim 1, wherein the polyamide fiber has a stress per unit fineness of 2.0 cN/dtex or more in 15% elongation in a tensile test of the fiber, and a stress P1 in 15% elongation in a tensile test of the fiber before 100° C. boiling water treatment under no load for 30 minutes and a stress P2 in 15% elongation in a tensile test of the fiber after the treatment satisfy Formula (2):

$$P2/P1>0.8 \quad (2).$$

3. The polyamide fiber according to claim 1, wherein 50% by mass or more of monomers constituting polyamide contained in the polyamide fiber is a biomass-derived monomer.

4. The polyamide fiber according to claim 2, wherein 50% by mass or more of monomers constituting polyamide contained in the polyamide fiber is a biomass-derived monomer.

5. A fabric comprising the polyamide fiber according to claim 1.

6. A fabric comprising the polyamide fiber according to claim 2.

7. A fabric comprising the polyamide fiber according to claim 3.

8. A fabric comprising the polyamide fiber according to claim 4.

* * * * *